US011816966B2

(12) United States Patent
Berglund et al.

(10) Patent No.: US 11,816,966 B2
(45) Date of Patent: *Nov. 14, 2023

(54) LOW PROFILE MERCHANDISE SECURITY SYSTEM

(71) Applicant: InVue Security Products Inc., Charlotte, NC (US)

(72) Inventors: David N. Berglund, Indian Trail, NC (US); Daniel D. Dugas, Charlotte, NC (US); Jeffrey A. Grant, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/462,980

(22) Filed: Aug. 31, 2021

(65) Prior Publication Data

US 2021/0398405 A1 Dec. 23, 2021

Related U.S. Application Data

(63) Continuation of application No. 16/841,156, filed on Apr. 6, 2020, now abandoned, which is a continuation (Continued)

(51) Int. Cl.
*G08B 13/14* (2006.01)

(52) U.S. Cl.
CPC ..... *G08B 13/1454* (2013.01); *G08B 13/1445* (2013.01); *G08B 13/149* (2013.01)

(58) Field of Classification Search
CPC ..... G08B 13/1454; G08B 13/1445; G08B 13/149

(Continued)

(56) References Cited

U.S. PATENT DOCUMENTS 6,039,498 A 3/2000 Leyden et al.
6,476,717 B2 11/2002 Gross et al.

(Continued)

FOREIGN PATENT DOCUMENTS

JP 2013-3937 1/2013

OTHER PUBLICATIONS

International Search Report and Written Opinion from corresponding International Application No. PCT/US2016/030741, dated Aug. 5, 2016 (8 pages).

(Continued)

*Primary Examiner* — Brian A Zimmerman
*Assistant Examiner* — Thang D Tran
(74) *Attorney, Agent, or Firm* — InVue Security Products Inc.

(57) ABSTRACT

Embodiments of the present invention are directed to security systems for securing an item of merchandise from theft or unauthorized removal. For example, the security system may include a sensor configured to be coupled to the item of merchandise and a base configured to removably support the sensor and the item of merchandise thereon. The sensor has a generally L-shaped surface for being secured to a portion of the rear and bottom surfaces of the item of merchandise. The base includes a charging circuit for providing power to the sensor and/or the item of merchandise.

20 Claims, 8 Drawing Sheets

Related U.S. Application Data of application No. 15/570,925, filed as application No. PCT/US2016/030741 on May 4, 2016, now Pat. No. 10,614,683.

(60) Provisional application No. 62/157,110, filed on May 5, 2015.

(58) Field of Classification Search
USPC ..... 340/568.2
See application file for complete search history.

(56) References Cited

U.S. PATENT DOCUMENTS 7,724,135 B2 5/2010 Rapp et al.
8,242,906 B2 8/2012 Fawcett
8,368,536 B2 2/2013 Fawcett et al.
8,698,618 B2 4/2014 Henson et al.
8,847,759 B2 * 9/2014 Bisesti ..... G08B 13/1463 340/568.4
9,499,373 B1 11/2016 Kim
10,614,683 B2 4/2020 Berglund et al.
2005/0073413 A1 * 4/2005 Sedon ..... G08B 13/149 340/568.8
2005/0206521 A1 9/2005 Frederiksen
2005/0206522 A1 9/2005 Leyden et al.
2006/0164243 A1 * 7/2006 Ott ..... E05B 73/0005 340/571
2006/0290359 A1 12/2006 Bom et al.
2007/0080806 A1 4/2007 Lax et al.
2008/0168806 A1 7/2008 Belden et al.
2008/0169923 A1 7/2008 Belden et al.
2009/0033492 A1 2/2009 Rapp et al.
2009/0079566 A1 * 3/2009 Goldstein ..... G08B 13/1463 340/568.1
2010/0118144 A1 5/2010 Fawcett et al.
2011/0187531 A1 * 8/2011 Oehl ..... G08B 13/1445 340/568.1
2011/0227735 A1 9/2011 Fawcett et al.
2011/0309934 A1 12/2011 Henson et al.
2012/0019383 A1 1/2012 Fawcett et al.
2012/0099256 A1 4/2012 Fawcett et al.
2012/0120571 A1 5/2012 Bisesti et al.
2012/0182146 A1 7/2012 Berglund et al.
2012/0188082 A1 * 7/2012 Berglund ..... G08B 13/1445 340/568.2
2012/0192600 A1 * 8/2012 Johnston ..... A47F 7/024 70/58
2012/0280810 A1 * 11/2012 Wheeler ..... H04M 1/04 340/568.1
2012/0293330 A1 * 11/2012 Grant ..... G08B 21/0286 340/568.8
2013/0149893 A1 6/2013 Bisesti et al.
2013/0194096 A1 * 8/2013 Belden, Jr. ..... G08B 13/1463 340/568.4
2013/0241731 A1 * 9/2013 Fawcett ..... G08B 13/1445 340/568.2
2013/0257616 A1 10/2013 Taylor et al.
2013/0307692 A1 11/2013 Fawcett et al.
2014/0022078 A1 * 1/2014 Brenner ..... G09F 27/00 340/568.2
2014/0060218 A1 * 3/2014 Bisesti ..... G01D 11/245 248/274.1
2014/0062698 A1 * 3/2014 Fawcett ..... G08B 13/1418 340/568.3
2014/0225733 A1 8/2014 Fawcett et al.
2014/0263873 A1 9/2014 Kim
2014/0340225 A1 * 11/2014 Grant ..... G08B 13/1445 340/568.2
2015/0009032 A1 1/2015 Wang et al.
2015/0235533 A1 * 8/2015 Grant ..... G08B 13/1445 340/568.2
2015/0351513 A1 * 12/2015 Park ..... A45C 13/18 150/102
2018/0293857 A1 10/2018 Berglund et al.
2020/0234550 A1 7/2020 Berglund et al.

OTHER PUBLICATIONS

Office Action from corresponding Korean Patent Application No. 2017-7035147, dated Aug. 8, 2018 (10 pages).

* cited by examiner

LOW PROFILE MERCHANDISE SECURITY SYSTEM

CROSS REFERENCE TO RELATED APPLICATIONS

The present application is a continuation of U.S. application Ser. No. 16/841,156, filed on Apr. 6, 2020, which is a continuation of U.S. application Ser. No. 15/570,925, filed on Oct. 31, 2017, and now U.S. Pat. No. 10,614,683, which is a 371 national phase entry of and claims priority to International Application No. PCT/US2016/030741, filed on May 4, 2016, which claims priority to and the benefit of U.S. Provisional Application No. 62/157,110, filed May 5, 2015, the contents of which are incorporated by reference herein in their entirety.

BACKGROUND OF THE INVENTION

Embodiments of the present invention relate generally to security systems for protecting items of merchandise, such as consumer electronics products.

It is common practice for retailers to provide demonstration models of relatively expensive consumer electronics products, such as handheld devices, tablets, and laptop computers, so that a potential purchaser may examine the product more closely and test the operation of its features. A working demonstration model, however, increases the possibility that the demonstration model will be stolen or removed from the display area by an unauthorized person. As a result, demonstration models of consumer electronics products are typically protected by a security system that permits a potential purchaser to examine and operate the product, while reducing the likelihood that the demonstration model will be stolen or removed from the display area.

The security system displays an item of merchandise so that a potential purchaser can readily view and, in some instances, operate the item when making a decision whether to purchase the item. At the same time, the item of merchandise is usually physically secured on the security system so as to prevent, or at least deter, theft of the item. The merchandise display security system may also include an alarm that is activated to alert store personnel in the event that a shoplifter attempts to separate the item of merchandise from the security system.

BRIEF SUMMARY

Embodiments of the present invention are directed to security systems and methods for securing an item of merchandise from theft or unauthorized removal. The security system includes a sensor configured to be coupled to the item of merchandise, and the sensor is configured to engage a portion of the rear and bottom surfaces of the item of merchandise. The security system also includes a base configured to removably support the sensor thereon, wherein the sensor comprises at least one electrical contact and the base comprises at least one electrical contact. The base comprises a charging circuit for transferring power to the sensor and/or the item of merchandise via the electrical contacts when the sensor is supported on the base, and the sensor is configured to detect unauthorized removal of the item of merchandise from the sensor.

In another embodiment, a security system includes a sensor configured to be coupled to the item of merchandise, and the sensor is configured to engage a portion of the rear and bottom surfaces of the item of merchandise. The security system also includes a base configured to removably support the sensor and the item of merchandise thereon, wherein the base is configured to transfer power to the sensor and/or the item of merchandise when the sensor is supported on the base. The security system further includes a cable connected to the sensor at one end and comprising at least one conductor for defining a sense loop for detecting removal of the cable or the item of merchandise from the sensor.

According to another embodiment, a security system includes a sensor configured to be coupled to the item of merchandise, wherein the sensor is configured to engage a portion of the rear and bottom surfaces of the item of merchandise. The security system also includes a base configured to removably support the sensor and the item of merchandise thereon. The sensor comprises at least one electrical contact and the base comprises at least one electrical contact configured to transfer power to the sensor and/or the item of merchandise when the sensor is supported on the base.

In another embodiment, a security system includes a sensor configured to be coupled to the item of merchandise, wherein the sensor is configured to engage a portion of the rear and bottom surfaces of the item of merchandise. The security system also includes a base configured to removably support the sensor and the item of merchandise thereon, wherein the sensor comprises at least one electrical contact and the base comprises at least one electrical contact configured to transfer power to the sensor and/or the item of merchandise when the sensor is supported on the base.

According to another embodiment, a method for securing an item of merchandise from theft or unauthorized removal includes coupling a sensor to an item of merchandise, wherein the sensor is configured to engage a portion of the rear and bottom surfaces of the item of merchandise. The method further includes positioning the sensor on the base such that the base transfers power to the sensor and/or the item of merchandise via at least one electrical contact on the sensor and at least one electrical contact on the base.

DETAILED DESCRIPTION OF EMBODIMENTS OF THE INVENTION

Figure 1:
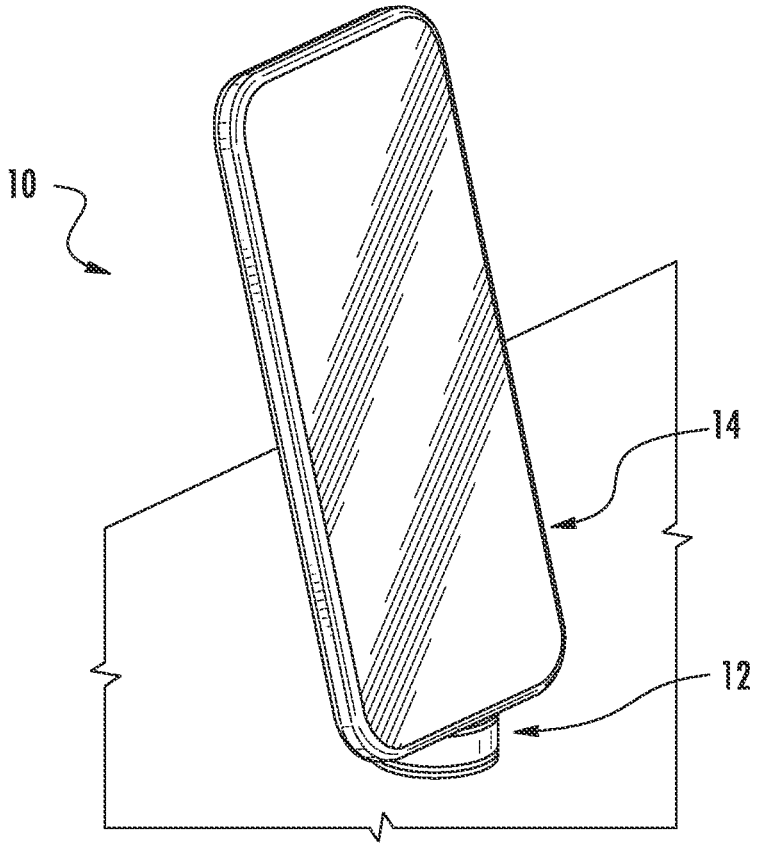
FIG. 1 is a perspective view of a security system according to one embodiment of the present invention.

Referring to the accompanying figures wherein identical reference numerals denote the same elements throughout the various views, embodiments of security systems according to the present invention for protecting an item of merchandise against theft or unauthorized removal are disclosed. The item of merchandise may be any item, including any number of consumer electronics products (e.g. hand-held device, cellular phone, smart phone, tablet, laptop computer, etc.). The security systems described herein are operable for securing the item of merchandise against theft or authorized removal, while at the same time permitting a potential purchaser to closely examine and operate the item of merchandise in a display area. The security system permits a potential purchaser to examine and test the item of merchandise, while reducing the likelihood that the item of merchandise will be stolen or removed from the display area by an unauthorized person. The systems shown and described herein are suitable for securing an item of merchandise in a residential or commercial environment, as well as a retail environment, and furthermore, is not intended to be limited to use only as a security display device for protecting against theft and/or unauthorized removal.

Figure 3:
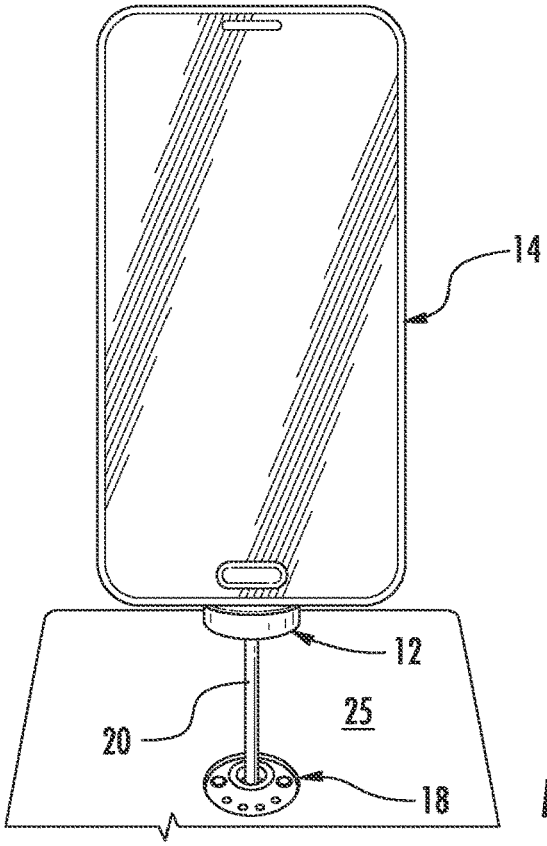
FIG. 3 is front view of the security system shown in FIG. 1 with the sensor lifted off of the base.
Figure 4:
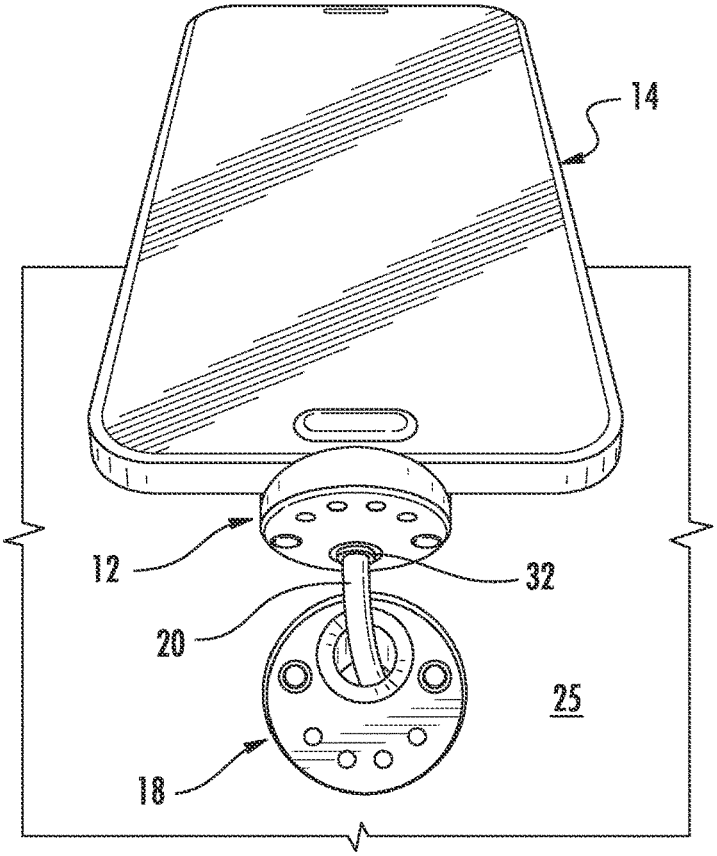
FIG. 4 is another front view of the security system shown in FIG. 1 with the sensor lifted off of the base.
Figure 5:
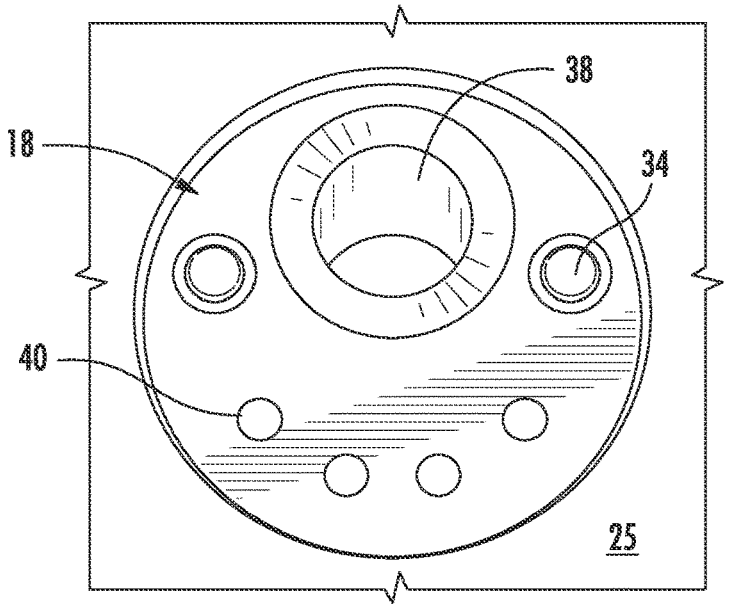
FIG. 5 is a top view of the base shown in FIG. 1.
Figure 12:
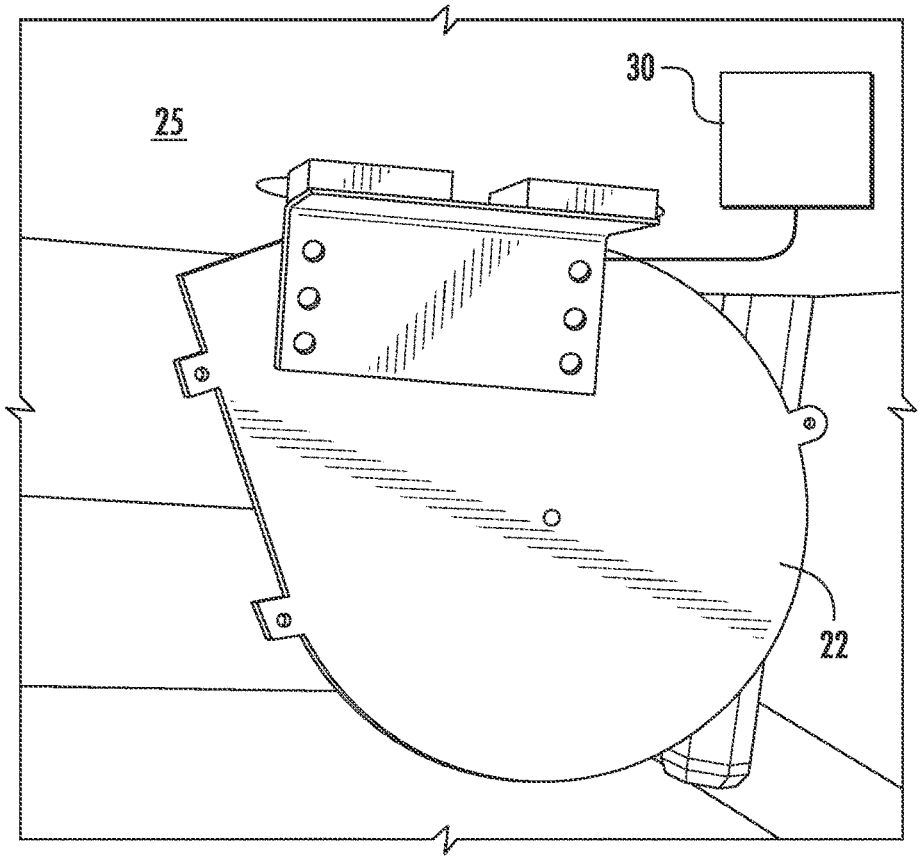
FIG. 12 is a schematic view of a recoiler mounted to a support surface according to an embodiment of the present invention.
Figure 13:
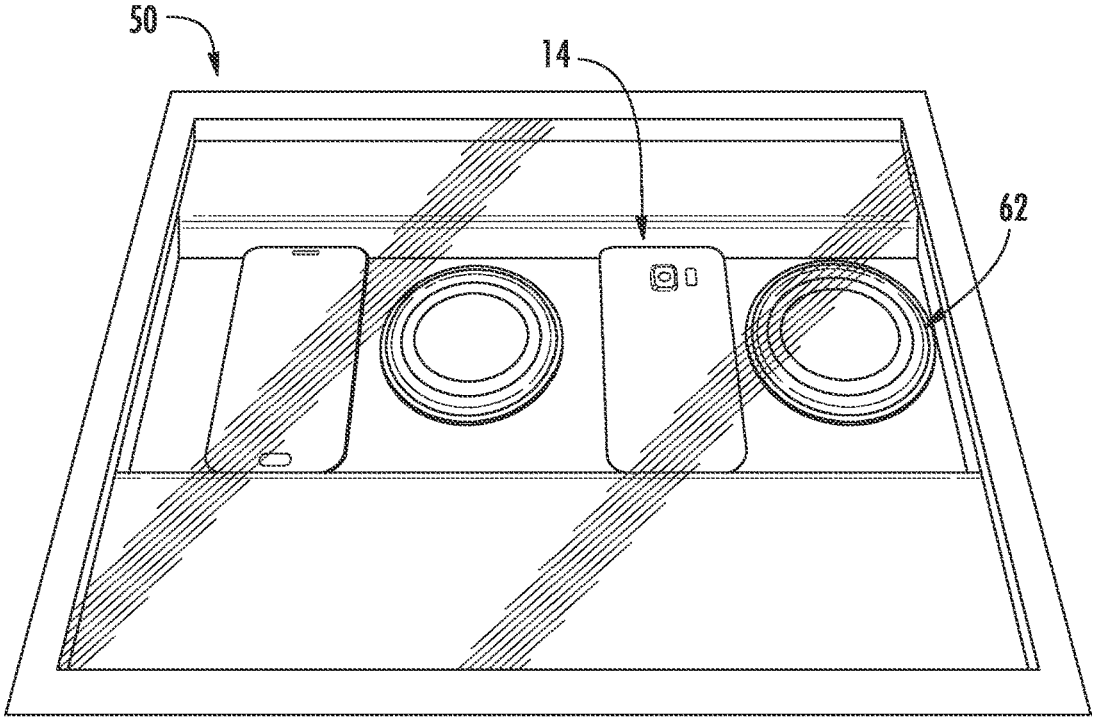
FIG. 13 is a top perspective view of a security system housing items of merchandise according to one embodiment of the present invention.
Figure 14:
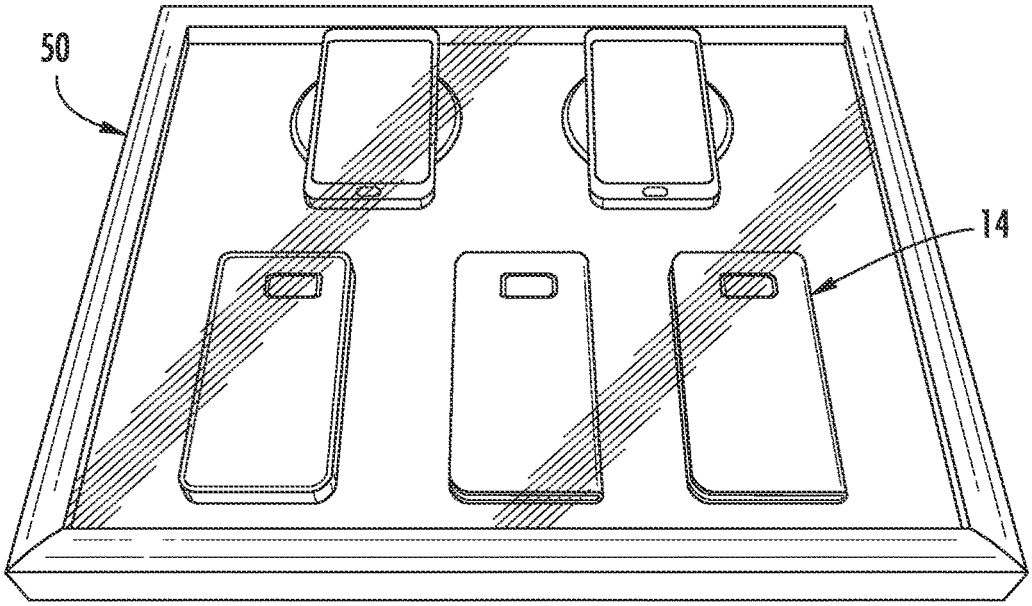
FIG. 14 is another perspective view of the security system shown in FIG. 13 with an alternative arrangement of items of merchandise.

According to one embodiment shown in FIG. 1, the security system 10 generally comprises a sensor 12 configured to be secured to an item of merchandise 14. The sensor 12 may be electrically connected to a connector 17 that is configured to electrically connect to an input jack of the item of merchandise 14. The security system 10 may also include a base 18 that is configured to removably support the sensor 12 and the item of merchandise 14 thereon. In some embodiments, the base 18 and the sensor 12 include one or more contacts 28, 40 for facilitating contact charging when the sensor is supported on the base. In addition, the security system 10 may also include a cable 20 that is coupled to the sensor 12 at one end and operably engaged with a recoiler 22 at an opposite end (see, e.g., FIGS. 3, 4, and 12). As explained in further detail below, in one embodiment a sense circuit or loop defined through the cable 20 may be electrically isolated from any charging circuit used to charge the sensor 12 and/or the item of merchandise 14. As such, the sense loop may be used to detect various security events associated with the cable 20, such as the cable being cut, shorted, and/or disconnected. The charging circuit allows for charging of the item of merchandise 14 and/or power source carried by the sensor 12. The sensor 12 may detect security events associated with the sensor and/or the item of merchandise 14, such as the item of merchandise being removed from the sensor.

Figure 2:
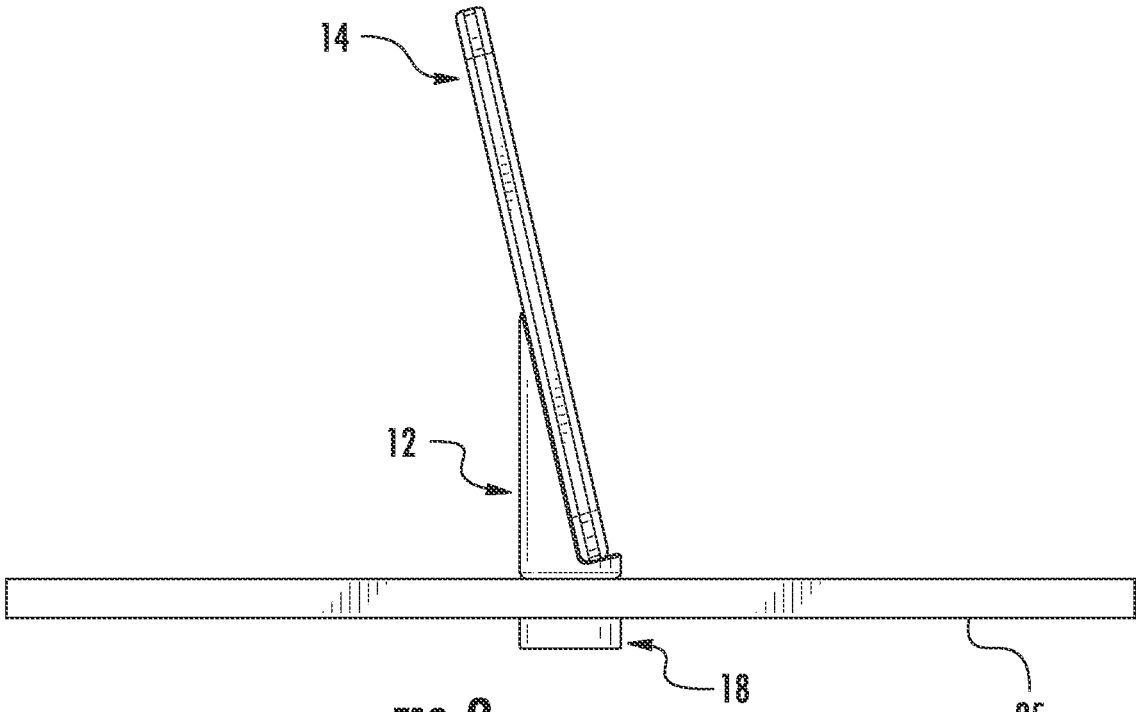
FIG. 2 is a side view of the security system shown in FIG. 1.

The sensor 12 may be secured to the item of merchandise 14 using any desired technique, such as an adhesive and/or mechanical brackets. The sensor 12 may have a variety of shapes and sizes for being secured to the item of merchandise 14. As shown in FIG. 2, the sensor 12 may have a generally L-shaped surface for being secured to a portion of the rear and bottom surfaces of the item of merchandise 14. For instance, the sensor 12 may have a "chair back" profile. As such, the sensor 12 is configured to engage both a portion of the rear and bottom surfaces of the item of merchandise. In some cases, the sensor 12 is configured to support the item of merchandise 14 in a desired display orientation. In addition, the connector 17 may be configured to be removably inserted into the input jack of the item of merchandise 14. Thus, the sensor 12 and the item of merchandise 14 may be electrically connected via the connector 17. The sensor 12 may include a printed circuit board (PCB), circuitry, or the like. For example, the sensor 12 may include charging circuitry for facilitating power transfer between the base 18 and the item of merchandise 14. The connector 17 may be electrically connected to the PCB using various techniques, such as via a cable or a flexible circuit. In one embodiment, a flexible circuit includes one or more conductors and is electrically connected to the PCB at one end and the connector 17. The flexible circuit eliminates the need for a separate external cable extending from the sensor 12 to the item of merchandise 14, while facilitating power transfer to the item of merchandise. Moreover, the flexible circuit has a low profile that allows the footprint of the sensor 12 to remain small, as well as allow flexibility in routing the connector 17 to various locations on the item of merchandise. In the illustrated embodiment, the connector 17 is mounted to and extends from the sensor 12 but could be positioned at other locations depending on the location of the input port of the item of merchandise 14.

As noted above, the sensor 12 may include one or more electrical contacts 28. In some embodiments, the sensor 12 includes a plurality of electrical contacts 28. The electrical contacts 28 may be in electrical communication with the PCB in the sensor 12 and the connector 17. Alternatively, the electrical contacts 28 may be electrically connected to only the PCB or the connector 17. In some embodiments, the sensor 12 may not supply power to the item of merchandise 14 when the item is lifted from the base 18. Rather, the item of merchandise 14 may operate using its own power source when lifted from the base 18.

Figure 6:
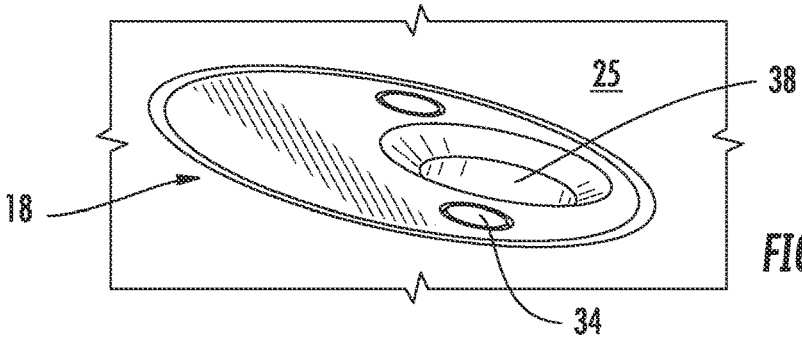
FIG. 6 is a perspective view of the base shown in FIG. 1
Figure 7:
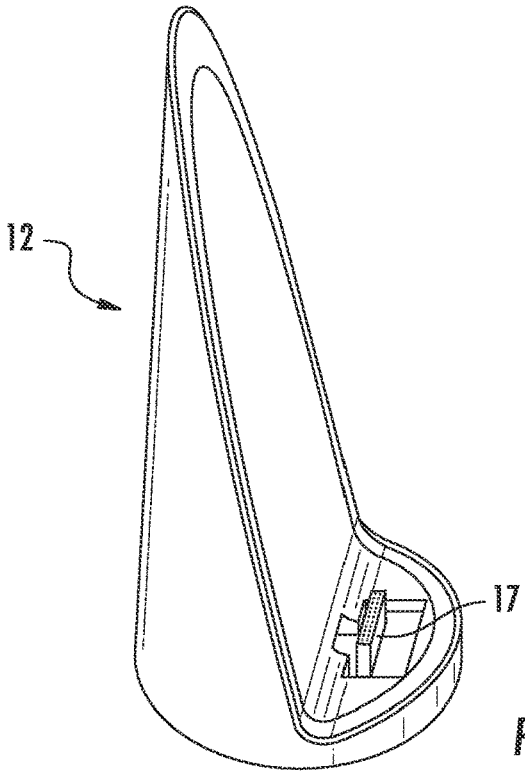
FIG. 7 is a perspective view of the sensor shown in FIG. 1.

The base 18 may be configured to be supported by a fixed support or display surface 25, such as a counter, shelf, fixture, or the like. In one embodiment, the base 18 is mounted so as to be flush with the upper surface of the support surface (see, e.g., FIG. 6). In some cases, the upper surfaces of the 18 and the support surface 25 may be parallel to one another to provide a flush mount. Thus, the base 18 may not be located above the support surface and is covered by the sensor 12 when mounted thereon, which provides a minimalistic footprint for the sensor while providing suitable support for the sensor and the item of merchandise 14. In some cases, the sensor 12 may entirely cover the base 18 so as to not be visible by customers when the sensor is supported on the base. The base 18 may be secured to the support surface using any desired technique such as an adhesive, brackets, and/or fasteners. The base 18 may extend at least partially through a thickness of the support surface 25 (see, e.g., FIG. 2). The base 18 may include one or more magnets 34 or magnetic material, and the sensor 12 may include or more magnets 36 or magnetic material for releasably holding the sensor on the base. The magnets 34, 36 may aid in aligning the item of merchandise 14 in a desired display orientation. Also, the magnets 34, 36 may be located off-center and along a perimeter of the bottom edge of the sensor 12 and item of merchandise 14, which provides adequate support with a minimal number of magnets needed to support the item of merchandise. This location of the magnets 34, 36 also allows the item of merchandise 14 to be readily removed from the base 18 when a removal force is applied at an opposite end of the item of merchandise. Moreover, the contacts 28, 40 may also located along the perimeter of the bottom edge of the sensor 12 and the base 18 to ensure that sufficient electrical contact is made between the contacts. It is understood that in other embodiments, the base 18 may be seated on the support surface 25 or project outwardly from the support surface in other embodiments.

The security system 10 may include a recoiler 22 and a cable 20 as discussed above. The base 18 may include an opening 38 for receiving the cable 20. As such, the cable 20 may be extended through the opening 38 when the sensor 12 and the item of merchandise 14 are lifted from the base, and the cable may be retracted through the opening when the sensor and the item of merchandise are returned to the base. The recoiler 22 may be spring biased in some embodiments such that the cable 20 is automatically retracted within the recoiler. The recoiler 22 and/or the alarm unit 30 may be mounted to an underside of the support surface 25 (see, e.g., FIG. 12). Furthermore, the alarm unit 30 may include a PCB, circuitry, or the like that is in electrical communication with the cable 20. In this regard, the cable 20 may include one or more electrical conductors extending along the length of the cable. In some cases, the cable 20 may include a pair of conductors for defining a sense loop or circuit and conducting an electrical signal. In other cases, the cable 20 may include a single conductor, such as an optical conductor for conducting an optical signal (e.g., a fiber optic cable). In other embodiments, the base 18 may be configured to house the recoiler 22 and/or alarm unit 30 therein.

As discussed above, the base 18 may include one or more electrical contacts 40. The contacts 28, 40 of the base 18 and the sensor 12 are configured to align with one another and contact one another when the sensor is supported on the base. Thus, the base 18 and the sensor 12 are in electrical communication with one another when the sensor is supported on the base. The base 18 may be electrically connected to a power source which is configured to provide power to the base and/or the one or more electrical contacts 40 in the base. The base 18 may also include charging circuitry that is configured to facilitate power transfer from the external power source and the electrical contacts 40. Thus, when the sensor 12 is supported on the base 18, power is able to be transferred between the contacts 28, 40 and to the sensor 12. The connector 17 is electrically connected to the sensor contacts 28 as power is delivered such that power is provided to the item of merchandise 14. Therefore, the item of merchandise 14 may be powered by power transferred thereto and may be used to charge a battery associated with the item of merchandise. In some embodiments, any voltage adaption occurs prior to being delivered to the sensor 12. Voltage adaption may be needed in order to accommodate different items of merchandise 14 that require different operating voltages. Any voltage adaption may occur prior to power being provided to the contacts 28 on the sensor 12. Thus, the sensor 12 and adapter cable 16 do not provide any voltage adaption. However, in other embodiments, the sensor 12 may include a resistor or other identifier that detects the voltage requirements of the item of merchandise 14 which provides a signal to the alarm unit 30 for adjusting the voltage as necessary before providing power to the sensor. Although the aforementioned embodiments describe that power may be transferred via contact charging, it is understood that other techniques could be used to transfer power to sensor 12 and the item of merchandise 14. For example, inductive charging functionality could be employed for transferring power.

In some cases, the base 18 and the sensor 12 may include an electrical contact that detects that the sensor is lifted off of the base. For example, the sensor 12 and base 18 may each include a contact that is configured to engage one another when the sensor is supported on the base. These contacts may not transfer power. However, the contact on the base 18 may communicate with the alarm unit 30 to indicate when the sensor 12 has been lifted off of the base and to cease transferring power to the electrical contacts 28, 40. This arrangement of contacts may reduce arcing and power surges when the sensor 12 is placed back on the base 18 since power will no longer be transferred to the contacts on the base after the sensor is lifted.

It is understood that the cable 20 may be any suitable cord, tether, or the like. In addition, the cable 20 may include one or more electrical conductors for transmitting electrical, security, data and/or communication signals. In addition, the cable 20 may be a single strand, multi-strand, or braided. The cable 20 may be flexible to facilitate extension and retraction relative to the recoiler 22, and in some embodiments, may be formed of a cut-resistant material. Furthermore, the cable 20 may have various cross sections, such as round or flat. In some embodiments, the security system 10 may not include a recoiler 22. Thus, the cable 20 could be a straight or coiled cable that is coupled to the sensor 12 at one end and electrically connected to the base 18 or alarm unit 30 at an opposite end.

An end of cable 20 may be mechanically secured to the sensor 12. Thus, the cable 20 is not electrically connected to the sensor 12 in any way, and the conductors in the cable are electrically isolated from the power transmitted to the sensor and the item of merchandise 14. In one embodiment, the sensor 12 may define an opening for receiving an end of the cable 20. The sensor 12 may define an opening for receiving the cable 20 such that the cable is not electrically connected to the sensor. In some embodiments, the end of the cable 20 includes a sensing element (e.g., a plunger switch) that is configured to contact the sensor 12 and/or the item of merchandise 14 and to detect when the cable is removed from the sensor 12 and/or the item of merchandise 14 in an unauthorized manner. It is understood that various types of sensing elements may be used for detecting when the cable 20 is attached or detached from the sensor 12 and/or item of merchandise 14. Furthermore, the end of the cable 20 may be coupled to the sensor 12 using a variety of techniques, such as via a removable connector 32, and may be configured to rotate or swivel in some embodiments. In one example, the sensing element and cable 20 may be configured to rotate relative to the item of merchandise 14, such as where the sensing element directly contacts the item of merchandise.

In other embodiments, an end of cable 20 may be electrically secured to the sensor 12. The cable 20 may be electrically connected to the sensor 12 for defining a sense loop therethrough, such as via connector 17. For example, the sense loop may be interrupted in response to the connector 17 being removed from the item of merchandise. In some cases, the end of the cable 20 may include a connector that is configured to be releasably secured to the sensor 12.

In one embodiment, the end of the cable 20 may be configured to rotate or swivel relative to the sensor 12 while still providing an electrical connection therebetween.

Various sensing techniques may be employed for determining whether the cable 20 has been cut or removed from the sensor 12 in an unauthorized manner. For example, the cable 20 may include a pair of electrical conductors that define a sense loop therethrough. Thus, should the sense loop be interrupted (e.g., by cutting or shorting the cable 20), the alarm unit 30 may detect the interruption and generate an alarm signal. For example, the alarm unit 30 may be configured to generate an audible alarm. The alarm unit 30 may be configured to be armed and/or disarmed via a key, such as a wireless key.

Figure 8:
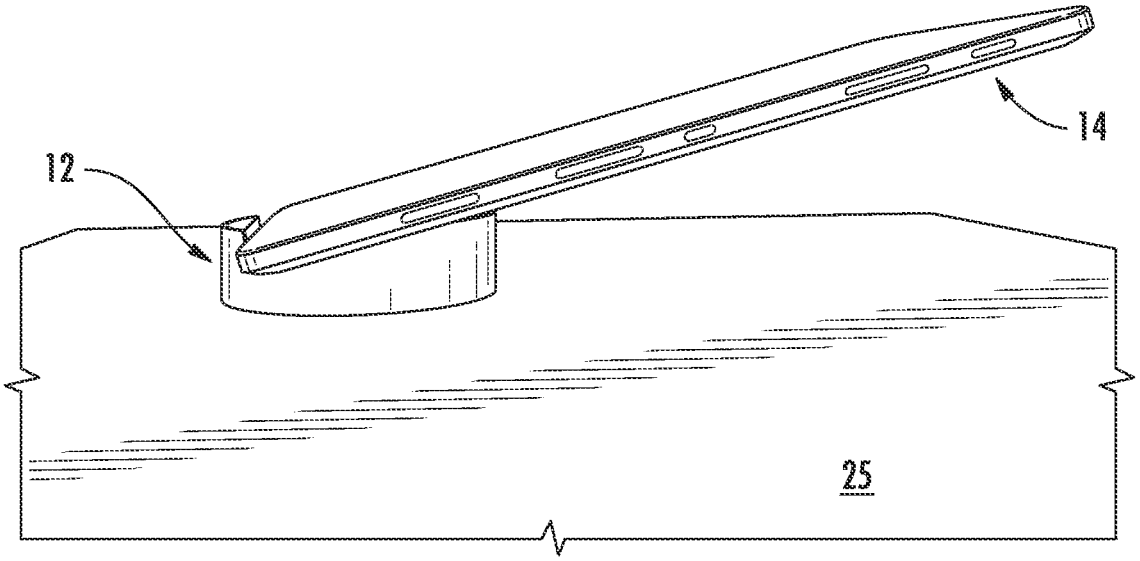
FIG. 8 is a side view a security system according to one embodiment of the present invention.
Figure 9:
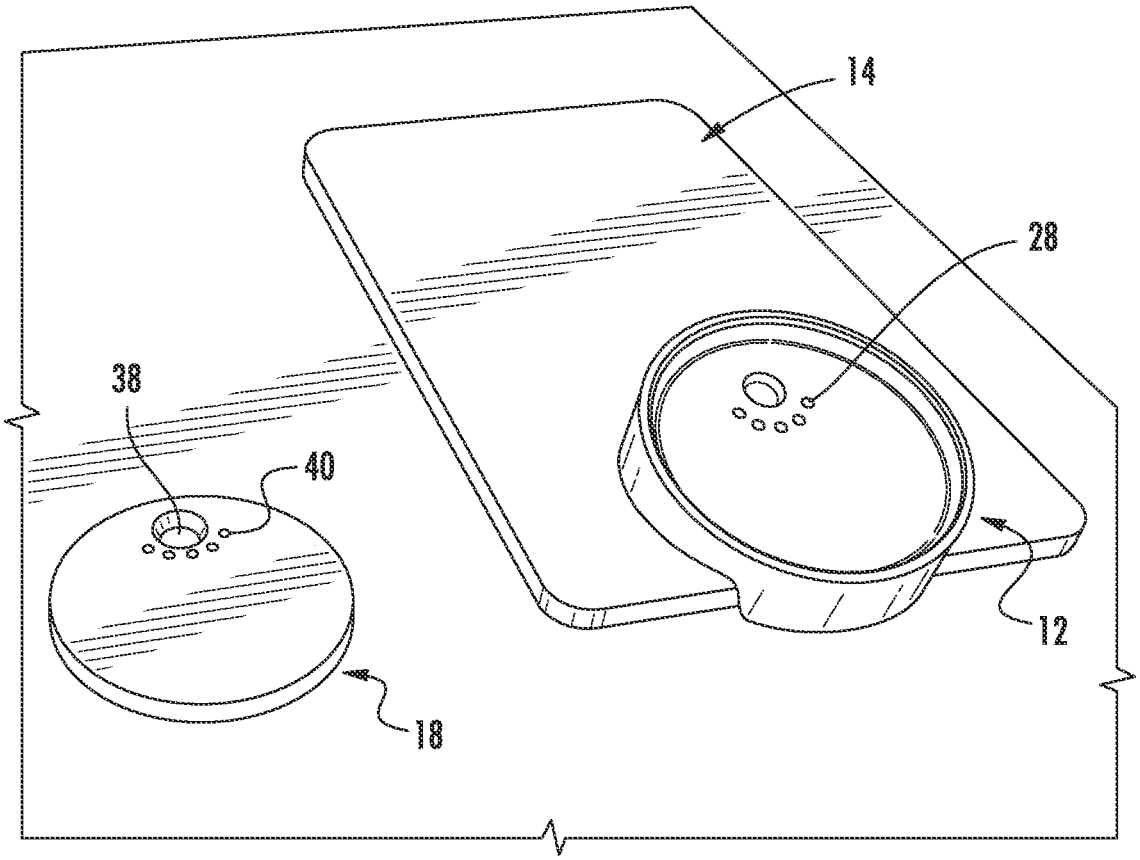
FIG. 9 is a top view of the security system shown in FIG. 8 with the sensor lifted off of the base.
Figure 10:
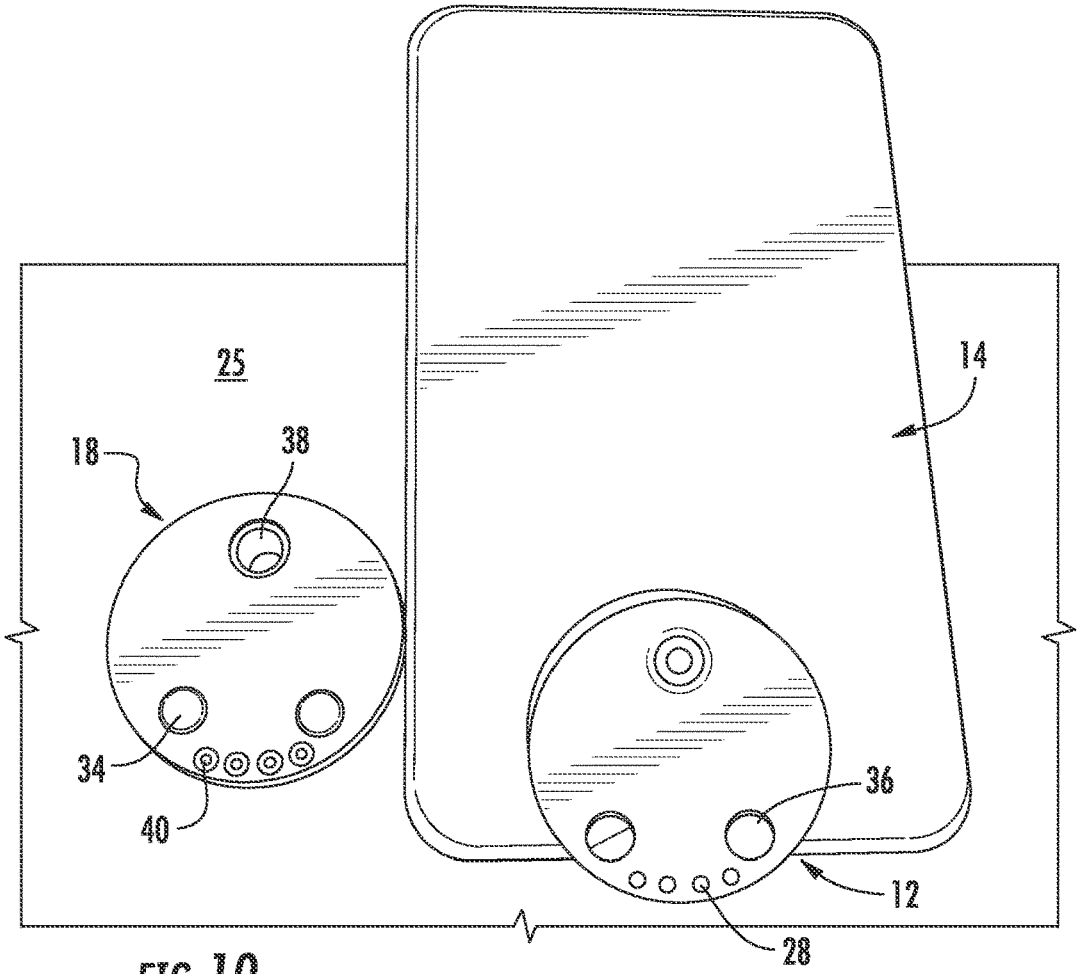
FIG. 10 is a top view a security system according to one embodiment of the present invention with the sensor lifted off of the base.
Figure 11:
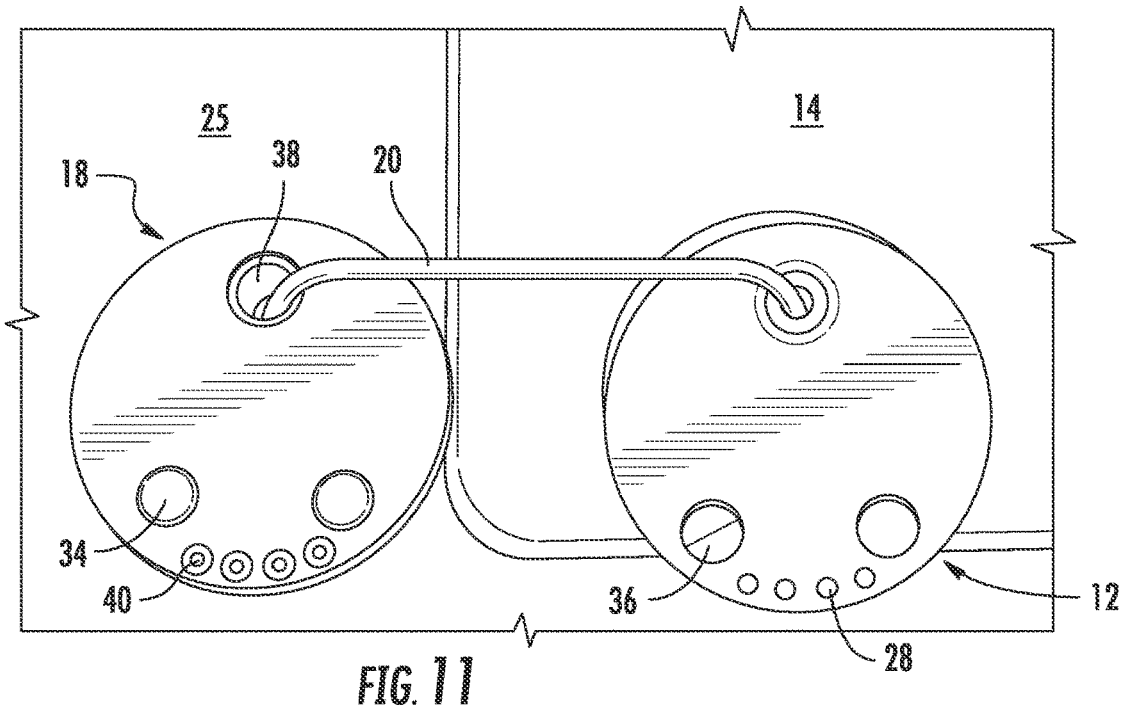
FIG. 11 is an enlarged top view of the security system shown in FIG. 10.

FIGS. 8-11 shows additional embodiments of a security system. The embodiments shown in FIGS. 8-11 may be used for larger items of merchandise 14 such as tablets or the like and function in a similar manner as that described above. FIG. 9 shows that the upper surface of the base 18 extends slightly above the upper surface of the support surface 25. The sensor 12 may include a recess that allows the sensor to receive the base 18 when supported thereon. Thus, as shown in FIG. 8, the base 18 is covered by the sensor 12 and is not visible to customers. In this instance, the height of the base 18 is less than a depth of the recess defined in the sensor 12. FIGS. 8-11 show that the sensor 12 and base 18 are circular in shape, although other shapes and configurations may be used. Moreover, FIG. 9 shows that the magnets 34, 36 and contacts 28, 40 may be located at other locations on the sensor 12 and the base 18 if desired.

FIGS. 13-18 show additional embodiments of the present invention relating to a concierge retail experience. In this embodiment, a powered display tray 50 is provided for receiving and displaying one or more items of merchandise 50. In on embodiment, the tray 50 may also or alternatively accommodate a power charging device 62, such as inductive charging device such that power may be transferred from the charging device to an item of merchandise 14 resting or otherwise electrically communicating with the charging device. The tray 50 may be configured to be portable such that a sales associate may remove the tray from a home location and transport the tray for convenient presentation to a customer. In some cases, the tray 50 is configured to accommodate a plurality of items of merchandise 50. The tray 50 may include a transparent cover if desired, which may include a lock in some cases. The items of merchandise 14 may be similar devices or configured to function together for providing a display exhibit for the customer. For example, some of the items of merchandise 14 may be paired to one another (e.g., via Bluetooth) or present different colors or models of similar items.

Figure 15:
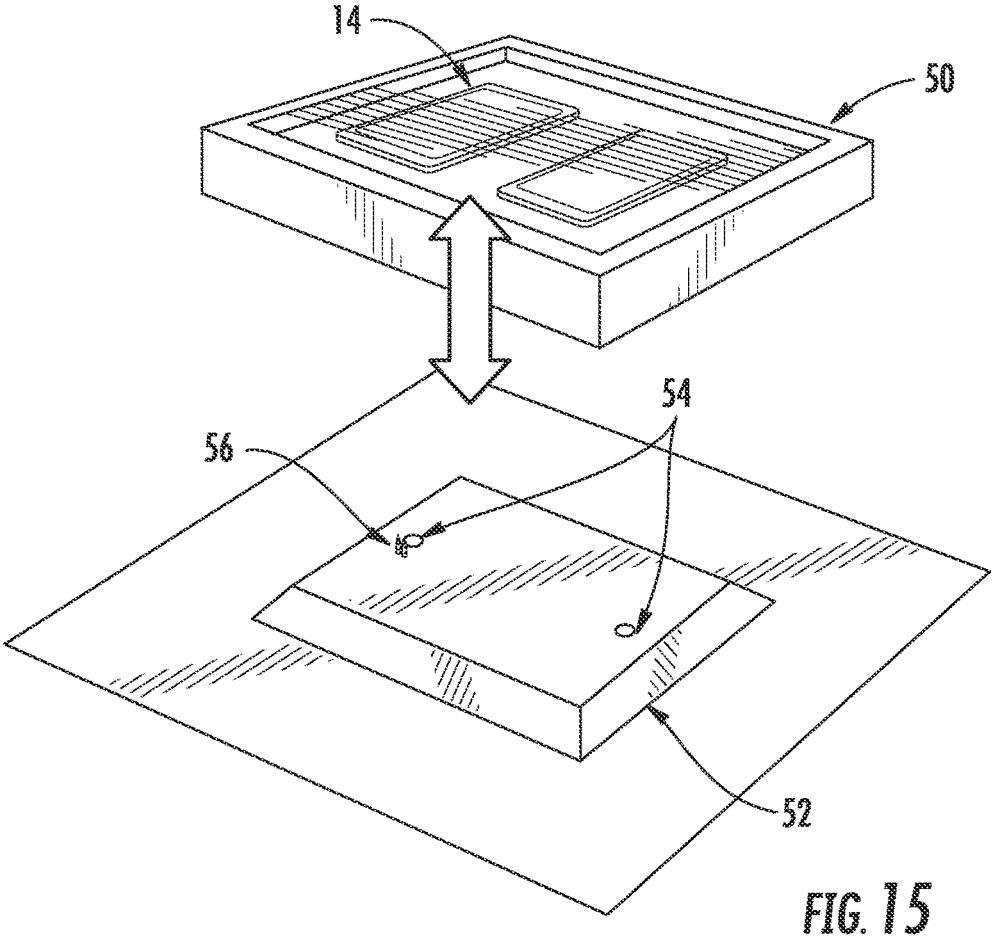
FIG. 15 is a perspective view of a security system according to another embodiment showing a tray lifted from a docking member.
Figure 16:
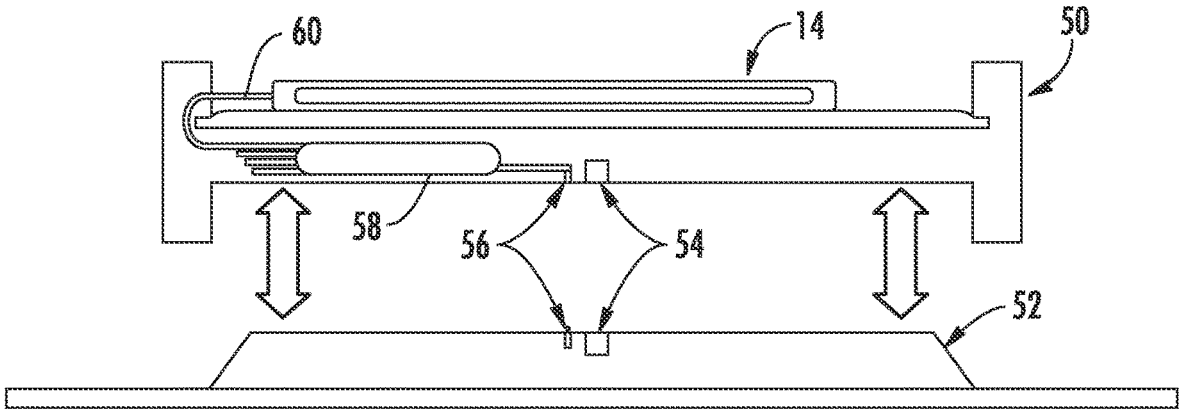
FIG. 16 is a side view of the tray lifted from the docking member shown in FIG. 15.
Figure 17:
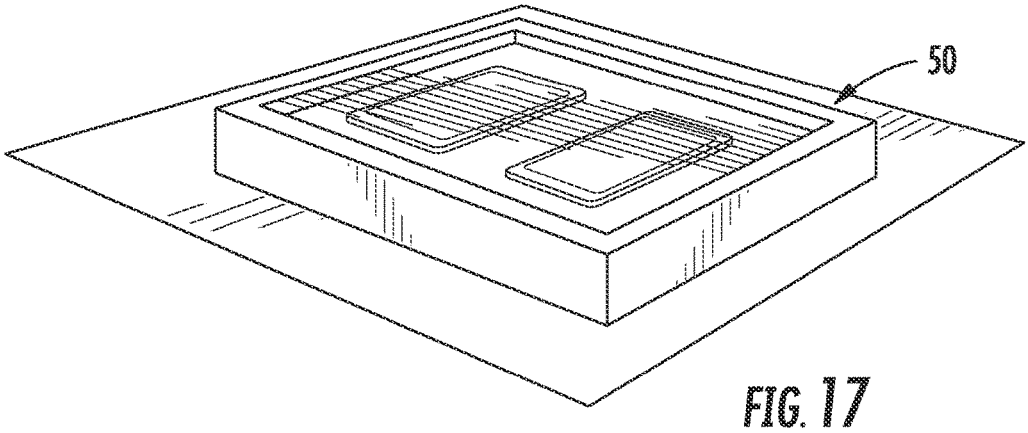
FIG. 17 is a perspective of the tray seated on the docking member shown in FIG. 15.
Figure 18:
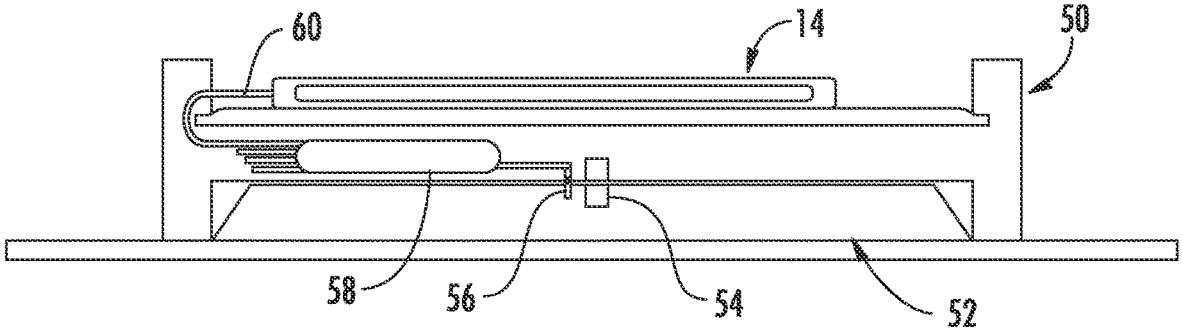
FIG. 18 is a side view of the tray seated on the docking member shown in FIG. 15.

The tray 50 may be configured to facilitate power transfer to the items of merchandise 14 on display. For instance, FIGS. 15-16 show the tray 50 in a lifted position where it can be seen that the tray 50 is removable from a docking member 52. The tray 50 and docking member 52 may include one or more magnets 54 or magnetically attractable material for providing a releasable connection and locating the tray on the docking member. The tray 50 and the docking member 52 may include one or more electrical contacts 56 for facilitating the transfer of power to the item of merchandise 14. The electrical contacts 56 may be "pogo pin" type electrical contacts in some instances. In some embodiments, the tray 50 includes a battery 58 for storing power that can be used to transfer power to the items of merchandise when lifted off of the docking member 52. FIGS. 17-18 show the tray 50 supported on the docking member 52 whereby electrical power is transferred via contact between the electrical contacts 56. As shown, the tray 50 may define a recess that is configured to receive the docking member 52 such that the docking member is covered by the tray when supported thereon. Similar to that discussed above, the tray 50 may entirely cover the docking member 52. Power may be transferred directly to the item of merchandise 14 via an adapter cable or flexible circuit 60 electrically connected to an input port on the item of merchandise (see, e.g., FIG. 16). Furthermore, the adapter cable 60 may be electrically connected to an alarm unit 30 in some embodiments such that removal of the cable 60 from the item of merchandise may result in a security event.

Therefore, embodiments of the present invention may provide several advantages. As noted above, the sense loop and the charging circuit may be electrically isolated from one another. Because the cable 20 does not require conductors for transferring power, the cable may only require one or two conductors, which reduces the overall diameter of the cable. In addition, since the conductor(s) in the cable 20 may be electrically isolated from the charging circuit and any voltage adaption may occur in the base 18, the cable may also be simplified in construction in order to define a sense loop. It is also possible that a greater effective length of cable 20 may be used for a similarly sized recoiler 22 since a smaller diameter wire may be used. Moreover, the pull force required to extend the cable 20 from the recoiler 22 may also be reduced in view of larger cables (e.g., less than 1 lb). Moreover, the base 18 may not require a slip ring for electrically communicating with the recoiler 22 and the cable 20. Similarly, no slip may be required for electrical communication between the sensor 12 and the end of the cable 20 since only a mechanical connection takes place. It is also possible that less "wear and tear" may take place on the cable 20, sensor 12, and base 18 since lighter and smaller components may be used. In addition, the low-profile base 18 allows the base to be at least partially covered, and even entirely in some cases, which provides a minimalistic support for the sensor 12 and the item of merchandise 14 while at the same time providing adequate support for seating the sensor on the base as well as providing power to the sensor and/or the item of merchandise.

The foregoing has described one or more embodiments of security systems for securing an item of merchandise from theft or unauthorized removal. Although various embodiments of the present invention have been shown and described, it will be apparent to those skilled in the art that various modifications thereto can be made without departing from the spirit and scope of the invention. Accordingly, the foregoing description is provided for the purpose of illustration only, and not for the purpose of limitation.

That which is claimed is:

1. A security system for securing an item of merchandise from theft or unauthorized removal, the item of merchandise having a rear surface and a bottom surface, the security system comprising:

a sensor configured to be coupled to the item of merchandise and further configured to detect unauthorized removal of the item of merchandise from the sensor, the sensor having a generally L-shaped surface configured to engage a portion of the rear and bottom surfaces of the item of merchandise, wherein the sensor further comprises a connector disposed on the generally L-shaped surface configured to engage an input port on the item of merchandise for electrically connecting the sensor to the item of merchandise;

a base configured to removably support the sensor thereon and a cable connected to the sensor and configured to tether the sensor relative to the base, wherein the sensor does not include an external cable for electrically connecting to the input port of the item of merchandise.

2. The security system of claim 1, further comprising a flexible circuit electrically connecting the connector and the sensor for providing power to the sensor and/or the item of merchandise.

3. The security system of claim 1, wherein the cable comprises at least one conductor for defining a sense loop.

4. The security system of claim 3, further comprising an alarm unit operably engaged with the cable and configured to generate an alarm signal when the item of merchandise is removed from the sensor or the sense loop is interrupted.

5. The security system of claim 3, wherein the base comprises a charging circuit for providing power to the sensor and/or the item of merchandise.

6. The security system of claim 3, wherein the at least one conductor does not transmit power to the sensor and/or the item of merchandise.

7. The security system of claim 1, wherein an end of the cable comprises a sensing element configured to contact the item of merchandise.

8. The security system of claim 1, wherein an end of the cable comprises a connector configured to releasably engage the sensor.

9. The security system of claim 8, wherein the end of the cable is configured to rotate relative to the sensor.

10. The security system of claim 1, wherein the base comprises an upper surface configured to removably support the sensor thereon, and wherein the sensor is configured to entirely cover the upper surface of the base when supported thereon.

11. The security system of claim 10, wherein the upper surface of the base is configured to be positioned flush to an upper surface of a support surface such that the base is not located above the upper surface of the support surface.

12. The security system of claim 11, wherein the sensor comprises a bottom surface, and wherein the entire bottom surface is configured to be positioned flush to the upper surface of the base.

13. The security system of claim 1, wherein the sensor comprises a plurality of electrical contacts and the base comprises a plurality of electrical contacts for transferring power to the sensor and/or the item of merchandise when the sensor is supported on the base, the plurality of electrical contacts of the sensor and the base configured to contact one another for transferring power when the sensor is positioned on the base and to be separated from one another to cease transferring power when the sensor is removed from the base.

14. The security system of claim 13, wherein the sensor comprises a rear surface and a bottom surface opposite the L-shaped surface, and wherein the plurality of electrical contacts of the sensor are arranged on the bottom surface.

15. The security system of claim 1, wherein the cable is connected to the bottom surface of the sensor at one end and a recoiler at an opposite end.

16. The security system of claim 1, wherein the connector is mounted to and extends from the L-shaped surface.

17. The security system of claim 1, wherein the base comprises an opening configured to receive the cable therethrough.

18. A method for securing an item of merchandise from theft or unauthorized removal, the item of merchandise having a rear surface and a bottom surface, the method comprising:

coupling a sensor to an item of merchandise, the sensor having a generally L-shaped surface configured to engage a portion of the rear and bottom surfaces of the item of merchandise, wherein the sensor further comprises a connector disposed on the generally L-shaped surface configured to engage an input port on the item of merchandise for electrically connecting the sensor to the item of merchandise, wherein coupling does not include connecting an external cable to the input port of the item of merchandise;

connecting a cable to the sensor for tethering the sensor relative to the base; and positioning the sensor on the base for removably supporting the sensor and the item of merchandise on the base.

19. The method of claim 18, wherein positioning comprises positioning the sensor on the base such that the base transfers power to the sensor and/or the item of merchandise via a plurality of electrical contacts on the sensor and a plurality of electrical contacts on the base, the plurality of electrical contacts of the sensor and the base configured to contact one another when the sensor is positioned on the base for transferring power and to be separated from one another to cease transferring power when the sensor is removed from the base.

20. A security system for securing an item of merchandise from theft or unauthorized removal, the item of merchandise having a rear surface and a bottom surface, the security system comprising:

a sensor configured to be coupled to the item of merchandise and further configured to detect unauthorized removal of the item of merchandise from the sensor, the sensor having a generally L-shaped surface configured to engage a portion of the rear and bottom surfaces of the item of merchandise, wherein the sensor further comprises a connector disposed on the generally L-shaped surface configured to engage an input port on the item of merchandise for electrically connecting the sensor to the item of merchandise;

a base configured to removably support the sensor thereon; and a cable connected to the sensor and configured to tether the sensor relative to the base, wherein the sensor does not include an external cable for electrically connecting to the input port of the item of merchandise, and wherein the base comprises an opening configured to receive the cable therethrough.

* * * * *